US008313590B2

(12) United States Patent
Parson et al.

(10) Patent No.: US 8,313,590 B2
(45) Date of Patent: Nov. 20, 2012

(54) HIGH STRENGTH ALUMINIUM ALLOY EXTRUSION

(75) Inventors: Nicholas Charles Parson, Kingston (CA); Martin Fortier, Jonquiere (CA)

(73) Assignee: Rio Tinto Alcan International Limited, Montreal (CA)

( * ) Notice: Subject to any disclaimer, the term of this patent is extended or adjusted under 35 U.S.C. 154(b) by 0 days.

(21) Appl. No.: 12/630,650

(22) Filed: Dec. 3, 2009

(65) Prior Publication Data

US 2011/0135533 A1 Jun. 9, 2011

(51) Int. Cl.
*C22C 21/00* (2006.01)

(52) U.S. Cl. ..... 148/437; 420/553; 420/548; 420/540

(58) Field of Classification Search ..... 148/437; 420/540, 553, 550, 551, 548
See application file for complete search history.

(56) References Cited

U.S. PATENT DOCUMENTS

| | | | |
|---|---|---|---|
| 2,381,714 | A | 8/1945 | Beci |
| 3,306,787 | A | 2/1967 | Dies |
| 3,717,512 | A | 2/1973 | Sperry et al. |
| 4,139,400 | A | 2/1979 | Bennett |
| 4,618,382 | A | 10/1986 | Miyagi et al. |
| 4,999,061 | A | 3/1991 | Curtis et al. |
| 5,415,710 | A | 5/1995 | Shiina et al. |
| 5,503,690 | A | 4/1996 | Wade et al. |
| 5,976,278 | A | 11/1999 | Sircar |
| 6,192,978 | B1 | 2/2001 | Guzowski et al. |
| 6,408,938 | B2 | 6/2002 | Gray et al. |
| 6,423,163 | B2 | 7/2002 | Smolej et al. |
| 6,620,265 | B2 | 9/2003 | Kawahara et al. |
| 6,918,970 | B2 | 7/2005 | Lee et al. |
| 7,018,722 | B2 | 3/2006 | Toyama et al. |
| 2002/0040746 | A1 | 4/2002 | Kawai et al. |
| 2004/0028940 | A1 | 2/2004 | Toyama et al. |
| 2006/0166030 | A1 | 7/2006 | Suzuki et al. |
| 2007/0017605 | A1 | 1/2007 | Nakamura et al. |
| 2008/0003451 | A1 | 1/2008 | Suzuki et al. |
| 2008/0056932 | A1 | 3/2008 | Cho et al. |

FOREIGN PATENT DOCUMENTS

| | | |
|---|---|---|
| JP | 02008340 | 1/1990 |
| JP | 2002079370 | 3/2002 |
| JP | 2002275565 | 9/2002 |
| JP | 2004100017 | 4/2004 |
| JP | 2004244696 | 9/2004 |
| JP | 2004339582 | 12/2004 |
| JP | 2005126761 | 5/2005 |

(Continued)

OTHER PUBLICATIONS

"Aluminum and Aluminum Alloys", ASM International, 1993, p. 665-669.*

(Continued)

*Primary Examiner* — Roy King
*Assistant Examiner* — Janelle Morillo
(74) *Attorney, Agent, or Firm* — Banner & Witcoff, Ltd.

(57) ABSTRACT

An aluminium extrusion having a minimum section thickness and made from an aluminium alloy includes, in weight percent, between approximately 1.0 and 1.7 manganese, and between approximately 0.5 and 1.1 silicon, less than 0.3 iron with the balance being Al and inevitable impurities each less than 0.05 weight % and totaling less than 0.15 weight %, the extrusion being formed with an extrusion ratio less than 125 to retain a fibrous grain structure in which less than 40% of the minimum section thickness is recrystallized.

19 Claims, 8 Drawing Sheets

FOREIGN PATENT DOCUMENTS

| | | |
|---|---|---|
| JP | 2006002212 | 1/2006 |
| JP | 2006083424 | 3/2006 |
| JP | 2008208416 | 9/2008 |
| JP | 2009174052 | 8/2009 |
| WO | 0166812 | 9/2001 |

OTHER PUBLICATIONS

Effects of Ingot Homogenisation Conditions on Microstructures of 3003 Aluminium Alloy Extrusions, T Minoda and H Yoshida, R&D Centre-I, Sumitomo Light Met Tech Rep, 1998 39 (1) 20-25.

* cited by examiner

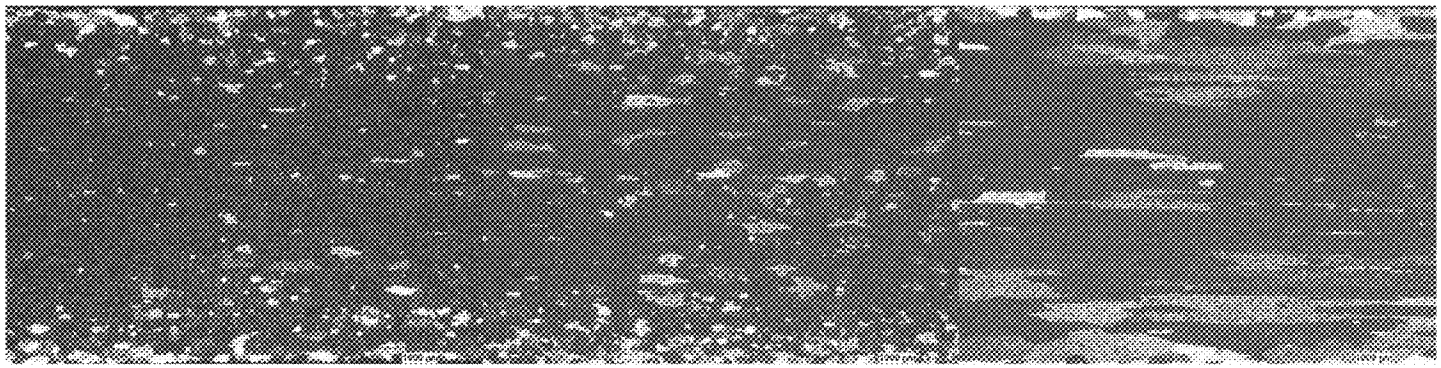
FIG. 4a (Alloy 1)
FIG. 4b (Alloy 2)
FIG. 4c (Alloy 3)
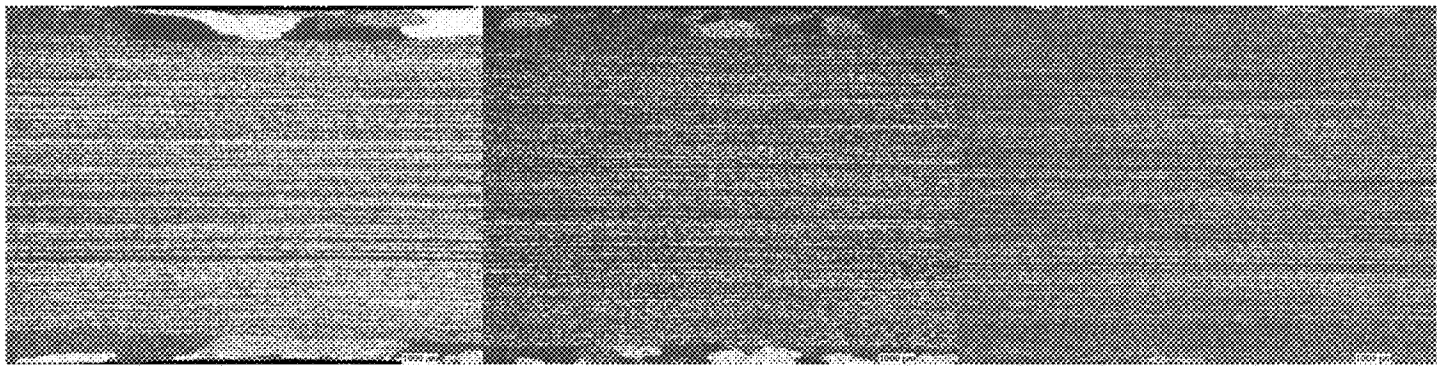
FIG. 4d (Alloy 4)
FIG. 4e (Alloy 5)
FIG. 4f (Alloy 6)

HIGH STRENGTH ALUMINIUM ALLOY EXTRUSION

TECHNICAL FIELD OF THE INVENTION

This invention relates to aluminium extrusions made from aluminium alloys containing manganese and silicon and, more particularly, to extrusions characterized by a relatively high strength for AA 3xxx based alloys

BACKGROUND

Aluminium alloys and, more particularly, 3xxx alloys are now very widely used in the manufacture of heat exchanger components for the automotive and heating ventilation and air conditioning and refrigeration (HVAC R) industries due to their combination of good corrosion resistance, formability, thermal stability and amenability to brazing. The heat exchanger components can be, without being limitative, rolled finstock, seam welded tubing from rolled sheet, as well as extruded tubes and profiles. The heat exchangers are typically assembled by furnace or flame brazing and mechanical connections.

For extrusions used in structural applications, 6xxx alloys, containing magnesium (Mg) and silicon (Si) as major alloying elements, are preferred since they have relatively good extrudability and benefit from precipitation hardening whereas the strength of current 3xxx alloys is relatively limited. However, the 6xxx alloys are difficult to braze. Furthermore, for applications where heavy cold forming is required, 6xxx alloys are typically used in the T4 temper which can undergo natural ageing. Thus, strength of 6xxx alloys increases with time after extrusion causing variable springback during bending. The 3xxx alloys are classed as non heat treatable and do not exhibit natural ageing and generally have better extrudability than the 6xxx. Therefore, several attempts have been made to improve the strength of 3xxx alloys without the addition of magnesium and in which the deliberate additions of magnesium are avoided because magnesium can be detrimental to extrudability.

U.S. patent application No. 2007/017605 describes one attempt to improve the strength of the aluminium alloy without the addition of magnesium. In the aluminium alloy, the ratio of manganese (Mn) content to silicon (Si) content was kept between 0.7 and 2.4. The extrusion billet is subjected to homogenization which includes a first-stage heat treatment in which the billet is maintained at 550 to 650° C. for two hours or more and a second-stage heat treatment in which the billet is cooled to 400 to 500° C. and maintained at that temperature for three hours or more. The billet is then heated at 480 to 560° C. before being extruded into multiport tubing. When manufacturing multi-port tubing, the extrusion ratio reaches several hundred to several thousand. Moreover, these prolonged heat treatments are energy intensive and time consuming.

The U.S. Aluminium Association (hereinafter called "AA") alloy 3003 (0.05 to 0.20 wt % of Cu, less than 0.6 wt % of Si, less than 0.7 wt % of Fe, 1.0 to 1.5 wt % of Mn, less than 0.10 wt % of Zn, and the balance Al) is a widely used 3xxx alloy which has many uses including extruded tubing. Tube stock can be drawn to improve mechanical properties but with associated costs. Moreover, tube stock drawing is difficult to achieve on more complex shapes such as automotive crash structures. When extruded, the original grain structure in the billet recrystallizes and the final product typically has a fine-grain structure.

The challenge is therefore to develop an aluminium extrusion that retains the advantageous properties of good corrosion resistance and formability provided by 3xxx alloys while, at the same time, improving its mechanical properties so that it can be used in applications requiring higher strength.

BRIEF SUMMARY OF THE INVENTION

It is therefore an aim of the present invention to address the above mentioned issues.

According to a general aspect, there is provided an aluminium extrusion having a minimum section thickness and made from an aluminium alloy having, in weight percent, between approximately 1.0 and 1.7 manganese, and between approximately 0.5 and 1.1 silicon, less than 0.3 iron with the balance being Al and inevitable impurities each less than 0.05 weight % and totaling less than 0.15 weight %, the extrusion being formed with an extrusion ratio less than 125 to retain a fibrous grain structure in which less than 40% of the minimum section thickness is recrystallized.

According to one aspect, the alloy includes additional copper up to 0.2 weight %.

According to another aspect, the extrusion is intended for use in corrosion resistant applications, and the alloy has additional alloying elements selected from the following: zinc greater than 0.10 and less than 0.30 weight %, titanium greater than 0.10 and less than 0.20 weight %, and a controlled copper content less than 0.01 weight %.

According to a further aspect, less than 25% of the minimum section thickness is recrystallized.

According to one aspect, the minimum section thickness is larger or equal to 1.0 mm, and according to another aspect, the minimum section thickness is larger or equal to 2 mm.

According to an additional aspect, the component has a yield strength higher than 50 MPa, a tensile strength higher than 125 MPa, and an elongation above 15%.

According to yet another aspect, the extrusion ratio is less than 75.

According to still further aspects, the manganese content ranges between approximately 1.4 and 1.6 wt %, and/or the silicon content ranges between approximately 0.5 and 0.7 wt %.

According to other aspects, the aluminium alloy is subjected to a single step homogenization.

According to additional aspects, the fibrous grain structure is centrally located within the wall of the extruded component.

BRIEF DESCRIPTION OF THE DRAWINGS

FIG. 4 includes FIGS. 4*a* to 4*f* and are micrographs of cross sections of alloys 1 to 6 respectively showing the as-extruded grain structures;

It will be noted that throughout the appended drawings, like features are identified by like reference numerals.

DETAILED DESCRIPTION

Figure 1A:
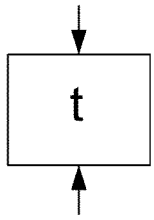
FIG. 1 includes FIGS. 1*a* to 1*j* which show variety of extrusion profiles with indication of "t" minimum thickness dimension.
Figure 1B:
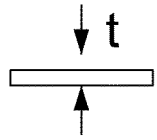
Figure 1C:
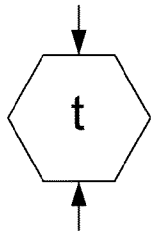
Figure 1D:
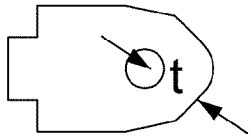
Figure 1E:
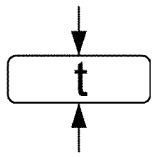
Figure 1F:
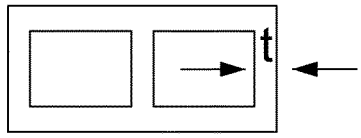
Figure 1G:
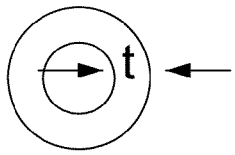
Figure 1H:
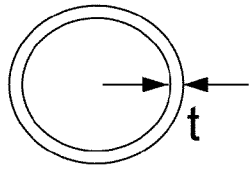
Figure 1I:
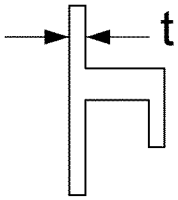
Figure 1J:
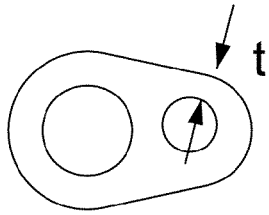

The aluminium extrusions according to one embodiment of the invention are made from an aluminium alloy containing, aside from aluminium and inevitable impurities, in weight percent, between 1.0 and 1.7 of manganese (Mn) and between 0.5 and 1.1 of silicon (Si). Inevitable impurities are controlled so that there is less than 0.3 of iron (Fe), less than 0.05 of titanium (Ti), and less than 0.05 of zinc (Zn). The aluminium extrusion is formed with an extrusion ratio less than 125 to retain a fibrous grain structure in which less than 40% of the minimum section thickness is recrystallized. Extrusion ratio may be understood as (cross sectional area of billet after upsetting inside the extrusion press)/(cross sectional area of extruded product, or combined cross sectional area if more than one profile is extruded from the same die).

The selected composition range and the appropriate extrusion conditions are selected to control the grain structure and, consequently, retain mostly a fibrous grain structure with improved strength compared to conventional 3xxx aluminium alloys. Furthermore, with the selected composition range, the aluminium extrusion has a good corrosion resistance.

The above-described aluminium extrusion alloy in accordance with one embodiment has a silicon content ranging between approximately 0.5 and 1.1 wt %. As will be described in more detail below, the appropriate combination of silicon and manganese additions promotes a fibrous structure in the aluminium extrusions. Consequently, improved strength compared to AA 3003 can be obtained. However, the aluminium alloy melting point typically decreases with the addition of silicon. Thus, in this embodiment, the silicon content of the alloy is kept below approximately 1.1 wt %. In another embodiment, the silicon content is above approximately 0.5 wt % and below approximately 0.7 wt %.

The addition of manganese is beneficial for strengthening; however, at relatively high content, manganese can also be detrimental to extrudability. As mentioned above, the properties of manganese as a strengthening agent are enhanced with an appropriate silicon addition. in one embodiment, for a silicon content ranging between approximately 0.5 and 1.1 wt %, a manganese content between approximately 1.0 and 1.7 wt % is beneficial for strengthening. In another embodiment, the aluminium alloy has a manganese content ranging between approximately 1.4 and 1.6 wt % in combination with a silicon content ranging between approximately 0.5 wt % and 1.1 wt %. In a further embodiment, the aluminium alloy has a manganese content ranging between approximately 1.4 and 1.6 wt % in combination with a silicon content ranging between approximately 0.5 wt % and 0.7 wt %.

High iron levels are detrimental to corrosion resistance while low iron levels are known to be beneficial for the quality of the extruded surface finish. In one embodiment, the aluminium extrusion has an iron content which is limited to below approximately 0.3 wt % since higher iron levels typically progressively deteriorate the extruded surface finish and reduce extrusion speed.

Copper of 0.1 to 0.2 weight % is typically added to AA3003 to increase strength. Copper is not a required alloying addition, particularly since the combination of manganese and silicon according to the invention improves strength. However, in one embodiment, to modify the corrosion mode of attack in corrosion sensitive applications, copper should be a controlled impurity, requiring careful furnace batching to keep the copper content below approximately 0.01 wt %.

Alloying additions of zinc and titanium are generally beneficial for corrosion resistant applications. To minimize costs, the maximum content of these costly alloying elements is limited according to the end use of the extrusion.

Titanium contents ranging between approximately 0.1 and 0.2 wt % can improve pitting corrosion resistance of aluminium alloys in corrosion sensitive applications. In one embodiment, when titanium is added as a grain refiner, the titanium content will generally be below 0.05 wt %.

Zinc additions can also be beneficial for corrosion resistance. In one embodiment of the alloy, zinc content ranges between 0.1 and 0.3 wt % for corrosion resistant applications, but otherwise the zinc content may be kept below 0.05 wt %.

It is appreciated that the alloying element content for a particular alloying element can be selected from any of the above-described embodiments and it can differ from the embodiment of another alloying element.

As mentioned above, in one embodiment, the aluminium extrusion according to the invention is formed with an extrusion ratio less than approximately 125/1, i.e. 125. In another embodiment, the extrusion ratio is less than approximately 75/1, i.e. 75.

In accordance with the invention, the aluminium extrusion can be a hollow profile or tube or a solid profile which has a wall or a section with a minimum section thickness. In one embodiment, the aluminium extrusion has a fibrous grain structure in which less than approximately 40%, expressed as a percentage of the minimum section thickness, is recrystallized. In an alternative embodiment, less than approximately 25% of the section thickness of the aluminium extrusion is recrystallized.

Before being extruded, the aluminium alloy billet can be subjected to a homogenization step carried out at a temperature below the aluminum alloy solidus and, generally, at a temperature below approximately 620° C. The billet can be subjected to a single homogenization step, i.e. the billet temperature is held at only one temperature and this is followed by a continuous cooling cycle.

In one embodiment, in order to maintain the suggested low extrusion ratio, the resulting aluminium extrusion will have a minimum section thickness "t" larger or equal to approximately 1.0 mm. In an alternative embodiment, the aluminium extrusion in accordance with the invention has a minimum section thickness "t" larger or equal to approximately 1.5 mm and, in still another embodiment, the minimum section thickness "t" is larger or equal to approximately 2 mm. FIGS. 1*a* to 1*j* show variety of example extrusion profiles with indication of the minimum section thickness "t". It is appreciated that the extrusion profiles are not limited to those shown in FIG. 1.

Typically, the aluminium extrusion according to one embodiment has a yield strength above 50 MPa, a tensile strength higher or equal to approximately 125 MPa, and an elongation above or equal to 15%.

The following experiments (experiments A, B and C) were conducted to show the criticality of the selected 3xxx compositions and extrusion conditions to produce aluminium extrusions with a retained fibrous grain structure and improved strength. The extrudability of the selected alloys was also evaluated.

Experiment A

A series of six (6) experimental alloys were direct-chill (DC) cast as 101 millimeter (mm) diameter billets. The compositions are shown in Table 1, reproduced below. Alloy AA 3003 was included as a reference material aluminium alloy in all experiments since it is a typical aluminium composition used for extrusions in a range of heat transfer applications. All the ingots were cut into billets of 405 mm lengths and then homogenized for four hours to the practices listed in Table 2, reproduced below. The homogenization temperature was varied according to the measured solidus (or melting point), which is also indicated in Table 2, to avoid melting during the homogenization treatment. The homogenization step was followed by a controlled cooling at a cooling rate below 200° C. per hour.

The billets were extruded on a 780 tonne and 106 mm diameter extrusion press into a 3 mm×41.7 mm strip, at an exit speed of 63 meters per minute, a ram speed of 15 mm per second, and water quenched at the press. The billets were preheated to 480° C. The extrusion ratio was 70/1 (or 70). These conditions represent typical commercial extrusion conditions for AA 3003. The mechanical properties of the extruded components were tested in the as-extruded condition. Grain structures of the extruded components were examined metallographically under polarized light after using a Barkers electrolytic etch.

Aluminium alloy 1 was AA 3003. Aluminium alloys 2 and 3 had higher manganese contents, the manganese content of aluminium alloy 3 being the highest. Aluminium alloys 4 to 6 had higher silicon contents, the silicon content of aluminium alloys 5 and 6 being the highest. Aluminium alloys 4 and 5 also had a manganese content similar to the manganese content of alloy 2. Finally, aluminium alloy 6 had a manganese content similar to the manganese content of alloy 3.

TABLE 2

Homogenization and Solidus Temperatures - Experiment A.

| | Temperature (° C.) | |
|---|---|---|
| Alloy | Solidus | Homogenization |
| 1 (AA 3003) | 644 | 620 |
| 2 | 645 | 620 |
| 3 | 643 | 620 |
| 4 | 636 | 615 |
| 5 | 621 | 600 |
| 6 | 624 | 600 |

Figure 2:
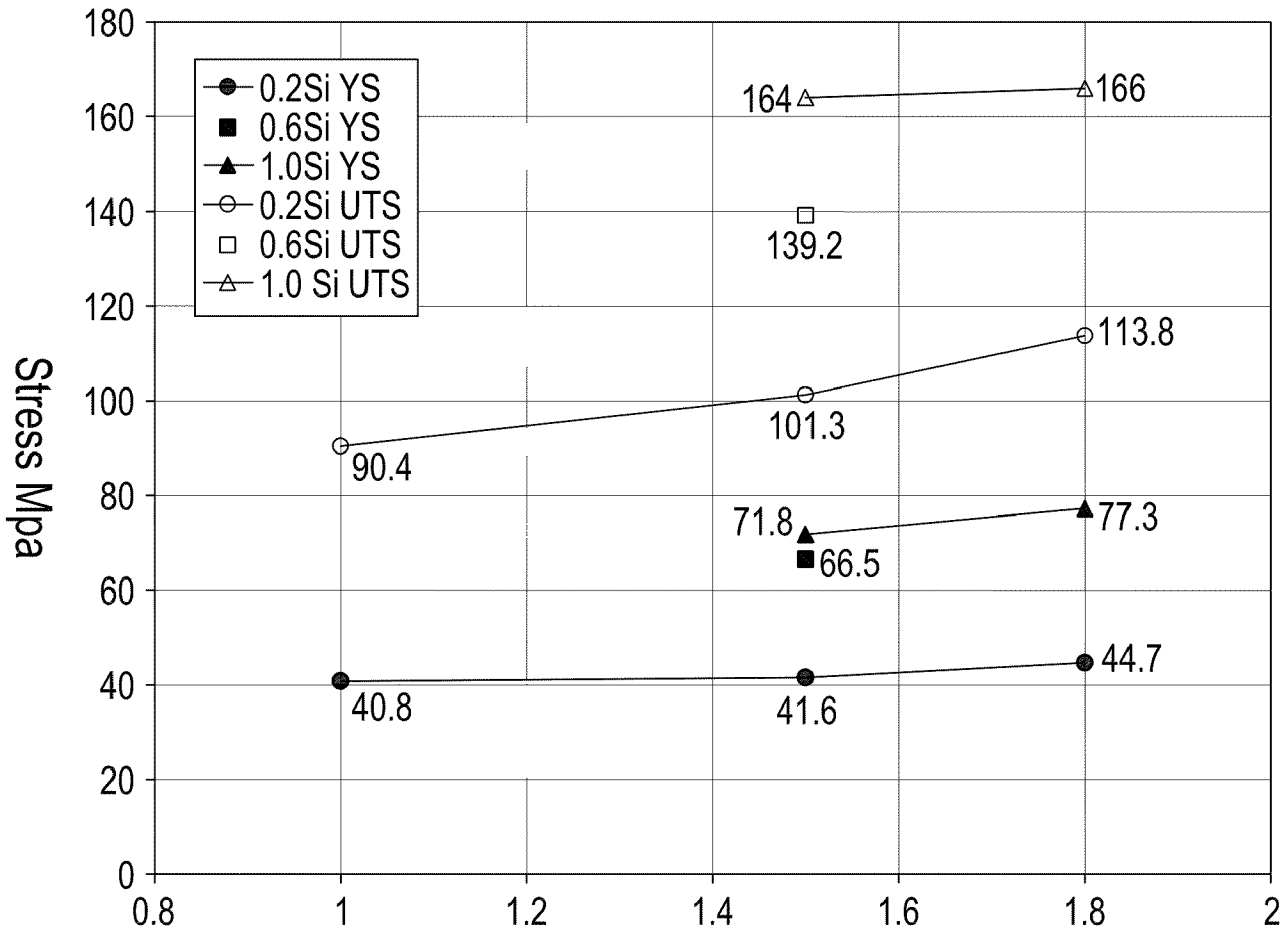
FIG. 2 is a graph showing the as-extruded tensile and yield strength values for the six (6) aluminium alloys presented in Table 1.

FIG. 2 illustrates the as-extruded yield strength (YS) and tensile strength (UTS) as a function of manganese content. Table 3, which is reproduced below, lists the data recorded during the tests. Typical commercial extruded AA 3003 contains approximately 0.2 wt % Si and approximately 1 to 1.1 wt % Mn. At the lowest silicon level tested, i.e. 0.23 wt %, increasing the manganese content above 1.0 wt % up to 1.8 wt % (alloys 2 and 3) only gave small improvements in yield strength and modest improvements in tensile strength. However, increasing the silicon content from 0.23 to 0.58 (alloy 4) gave a surprisingly large increase in yield strength of approximately 25 MPa or approximately 60% along with an increase in tensile strength of 38 MPa or approximately 38% compared to AA 3003 (alloy 1). Increasing the silicon content further to 1.0 wt % (alloys 5 and 6) did not give significant benefits to yield strength, but tensile strength improved by a further 25 MPa.

TABLE 3

Summary of Test Data - Experiment A.

| | in weight % (wt %) | | Stress (MPa) | | Elongation | P | Solidus | YSrel | Prel | YSrel/ | |
|---|---|---|---|---|---|---|---|---|---|---|---|
| Alloy | Si | Mn | YS | UTS | % | PSI | ° C. | % | % | Prel | RX, ext |
| 1 (3003) | 0.23 | 0.98 | 40.8 | 90.4 | 38.5 | 759 | 644 | — | — | — | 100 |
| 2 | 0.23 | 1.48 | 41.6 | 101.3 | 38.0 | 818 | 645 | 2.0 | 7.8 | 0.3 | 100 |
| 3 | 0.23 | 1.79 | 44.7 | 113.8 | 37.5 | 830 | 643 | 9.6 | 9.4 | 1.0 | 100 |
| 4 | 0.58 | 1.45 | 66.5 | 139.2 | 30.2 | 815 | 636 | 63.0 | 7.4 | 8.5 | 21 |
| 5 | 0.96 | 1.47 | 71.8 | 164.0 | 30.0 | 830 | 621 | 76.0 | 9.4 | 8.1 | 12 |
| 6 | 0.99 | 1.78 | 77.3 | 166.0 | 29.6 | 850 | 624 | 89.5 | 12.0 | 7.5 | 3 |

RX ext % of section thickness recrystallized as-extruded

TABLE 1

Experimental Aluminium Alloy Compositions - Experiment A.

| | in weight % (wt %) | | | | | |
|---|---|---|---|---|---|---|
| Alloy | Si | Fe | Cu | Mn | Ti | Zn |
| 1 (AA 3003) | 0.23 | 0.20 | 0.08 | 0.98 | 0.01 | <0.01 |
| 2 | 0.23 | 0.23 | 0.08 | 1.48 | 0.01 | <0.01 |
| 3 | 0.23 | 0.19 | 0.08 | 1.79 | 0.01 | <0.01 |
| 4 | 0.58 | 0.21 | 0.08 | 1.45 | 0.01 | <0.01 |
| 5 | 0.96 | 0.21 | 0.08 | 1.47 | 0.01 | <0.01 |
| 6 | 0.99 | 0.20 | 0.08 | 1.78 | 0.01 | <0.01 |

Figure 3:
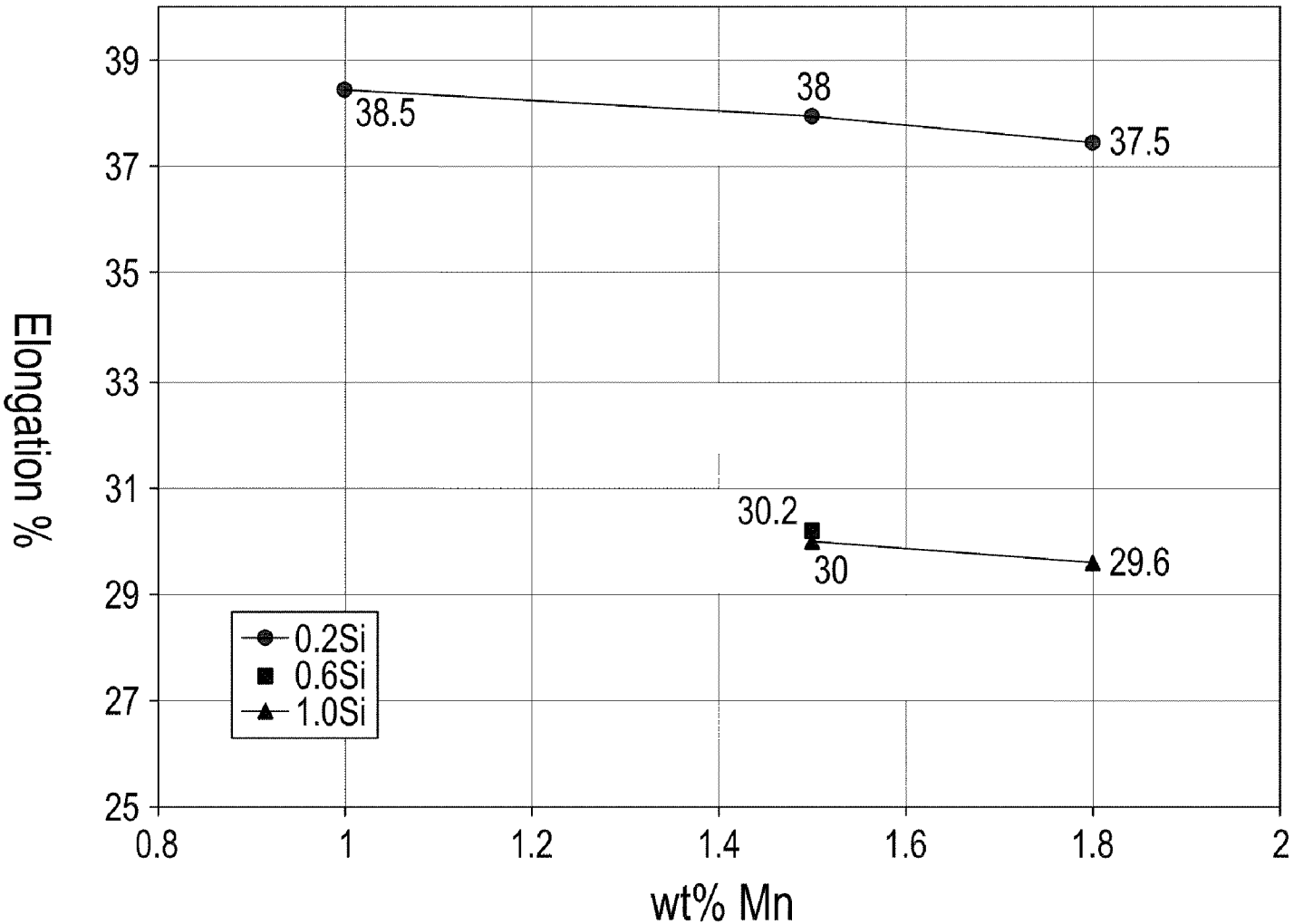
FIG. 3 is a graph showing the as-extruded elongation values for alloys 1 to 6 presented in Table 1.

Usually, elongation and yield strength have an inverse relationship, i.e. elongation decreases as yield strength increases. Good elongation or ductility is an important material parameter for applications where the extrusion is subjected to cold forming operations. As shown in FIG. 3 and Table 3, reproduced above, the higher strength alloys having at least 0.58 wt % Si (alloys 4 to 6) were characterized by lower elongation values than the baseline alloys having 0.23 wt % Si (alloys 1 to 3). Elongation values of approximately 30% were achieved for the higher strength alloys (alloys 4 to 6). These elongation values are suitable for most applications and better than most 6xxx aluminium alloys in the T4 temper.

FIG. 4 illustrates the extruded grain structure in the longitudinal direction for each alloy. The micrographs of FIGS. 4*a*, 4*b*, and 4*c* (alloys 1 to 3) show a fully recrystallized-grain structure while the micrographs of FIGS. 4*d*, 4*e*, and 4*f* (alloys 4 to 6) show a predominantly fibrous or unrecrystallized grain structure in the extruded component. Thus, the improvement in mechanical properties, with the addition of approximately 0.6 wt % or more silicon, is due at least in part, to the retention of the fibrous grain structure. This structure contains a residual hot worked substructure within the original as-cast grains, which increases strength and is unusual to observe in extruded 3xxx alloys. The fully recrystallized-grain structure obtained with alloys 1 to 3 is more typical.

The surface layer of grains for alloys 4, 5 and 6 was recrystallized. This is relatively common for extruded profiles. In direct extrusion, the surface layers of the profile experience higher levels of deformation, which can produce recrystallization earlier than the lower strain in the bulk of the section. When expressed as % of section thickness, alloys 4, 5, and 6 had recrystallized surface layers of 21, 12, and 3% respectively (RX,ext in Table 3). In other words, the ability to retain a fibrous structure continued to increase with higher silicon and manganese contents and lower homogenization temperatures.

Figure 5:
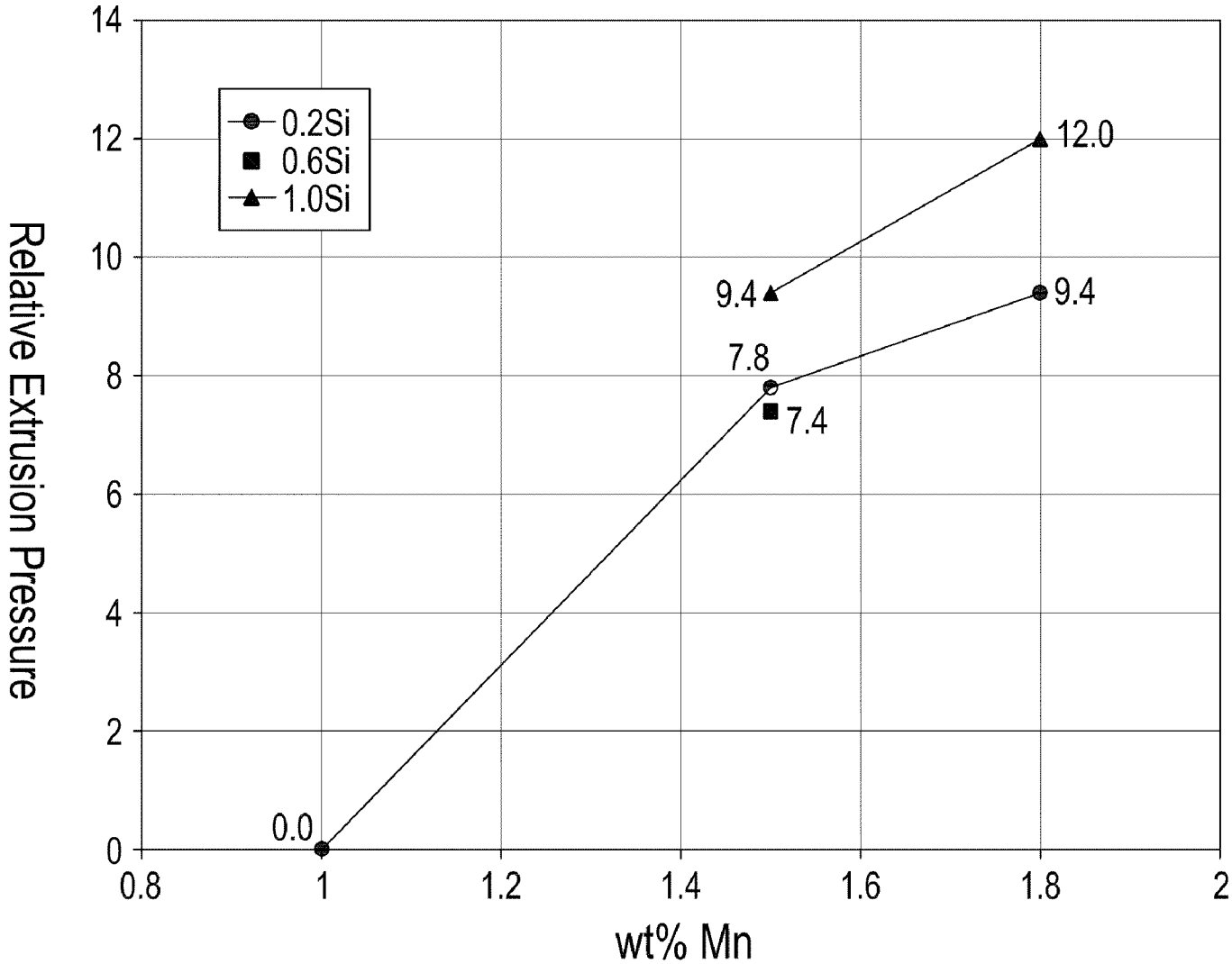
FIG. 5 is a graph showing the relative extrusion pressure versus weight % Mn in aluminium alloy AA 3003 for alloys 1 to 6 presented in Table 1.

The ability of an alloy to withstand high speed extrusion is a significant economic factor in the production of extruded components. This alloy characteristic is referred to as its "extrudability". One extrudability measure is the extrusion pressure required to extrude the alloy into a given shape. An alloy or alloy/homogenization temperature combination with a lower extrusion pressure can generally be extruded faster before the press capacity is exceeded. The extrusion pressure (P) was measured at a fixed ram position near the end of the ram stroke. FIG. 5 illustrates the relative extrusion pressure [PreI=(P−P,3003/P,3003)×100) averaged for two billets of each alloy], relative to the commercial AA 3003, expressed as a % of increase (PreI). For a silicon content of 0.23 wt % (alloys 1 to 3), increasing the manganese content from 1.0 to 1.8 wt % raised the extrusion pressure by 9% for only modest improvements in tensile properties. However, with a higher silicon content of approximately 0.6 wt % in combination with a manganese content of approximately 1.5 wt % (alloy 4), there was actually a slight reduction in the extrusion pressure. Large benefits in yield strength and tensile strength were also observed, as reported above (see Table 3). Increasing the silicon content further to 1.0 wt % (alloy 5) raised the extrusion pressure by approximately 2% for no significant improvement in yield strength, but a useful increment in tensile strength was achieved (approximately 25 MPa).

As mentioned above, Table 3 lists the data recorded during the tests. The behavior of the alloys can be compared by calculating the relative yield strength and extrusion pressure increases compared to the AA 3003 composition, i.e. YSreI and PreI respectively. The ratio of the yield strength increase/the extrusion pressure increase (YSreI/PreI) is a measure of the loss of extrudability required to obtain the benefits in strength, i.e. the measure of extrudability loss required to gain strength. A higher value is desirable, indicating that the strength improvement was obtained with minimal loss of extrudability. Alloys 4, 5, and 6 gave high values, alloy 4 (0.60 wt % Si and 1.5 wt % Mn) giving the highest value. The additions of manganese alone to the base alloy gave very low values (alloys 2 and 3).

Experiment B

In the second experiment, alloys 1 to 6, as previously described, were utilized along with further alloys 7 to 11. Alloys 7 to 11 were DC cast as 101 mm diameter billets in the same way as alloys 1 to 6. For this experiment, all alloys were homogenized for 4 hours at 600° C. and slowly cooled down. The homogenization step was followed by a controlled cooling at a cooling rate below 200° C. per hour.

The alloys were extruded using the same conditions as experiment A (Billet temperature: 480° C.; Ram speed: 15 mm/sec; Exit speed: 63 m/min; and Extrusion ratio: 70/1) into the same 3×41.7 mm strip and water quenched at the press. These conditions represent typical commercial extrusion conditions for AA 3003. The as-extruded longitudinal grain structures and tensile properties were evaluated and the results are summarized in Table 4, reproduced below. As for Experiment A, the grain structures are described in terms of the percentage of the cross-section recrystallized (Rx,ext).

Alloy 7 was similar to alloy 1 and again represented a typical commercial AA 3003. Aluminium alloys 8, 10 and 11 had a similar silicon content (approximately 0.6 wt %), alloys 8 and 11 having a similar manganese content of approximately 1.0 wt % and alloy 10 having a lower manganese content of 0.75 wt %. Alloy 11 had a lower copper content than alloy 8 (less than 0.01 wt % versus 0.08 wt %) and lower iron content (approximately 0.1 wt % versus 0.2 wt %). Aluminium alloy 9 had a manganese content similar to alloys 8 and 11 (approximately 1.0 wt %) and a higher silicon content (approximately 0.8 versus approximately 0.6).

TABLE 4

Results of Experiment B

| Alloy | Si wt % | Fe wt % | Cu wt % | Mn wt % | Ti wt % | Zn <0.01 | Rx, ext % | YS MPa | UTS MPa | Elongation % |
|---|---|---|---|---|---|---|---|---|---|---|
| 1 (3003) | 0.23 | 0.20 | 0.08 | 0.98 | 0.01 | <0.01 | 100 | 34.5 | 88.1 | 33.5 |
| 2 | 0.23 | 0.23 | 0.08 | 1.48 | 0.01 | <0.01 | 100 | 38.4 | 104 | 37.5 |
| 3 | 0.23 | 0.19 | 0.08 | 1.79 | 0.01 | <0.01 | 100 | 40.5 | 119 | 39 |
| 4 | 0.58 | 0.21 | 0.08 | 1.45 | 0.01 | <0.01 | 3 | 70 | 142.8 | 30 |
| 5 | 0.96 | 0.21 | 0.08 | 1.47 | 0.01 | <0.01 | 18 | 70 | 162 | 26.5 |
| 6 | 0.99 | 0.20 | 0.08 | 1.78 | 0.01 | <0.01 | <3 | 74.5 | 165 | 29 |
| 7 (3003) | 0.23 | 0.20 | 0.08 | 1.03 | 0.02 | <0.01 | 100 | 35.4 | 91.5 | 33.5 |
| 8 | 0.59 | 0.23 | 0.08 | 1.03 | 0.02 | <0.01 | 39 | 57 | 133 | 19 |
| 9 | 0.79 | 0.24 | 0.08 | 1.03 | 0.01 | <0.01 | 27 | 61 | 147 | 25 |
| 10 | 0.58 | 0.20 | 0.08 | 0.75 | 0.02 | <0.01 | 100 | 35 | 104 | 26.5 |
| 11 | 0.59 | 0.10 | <0.01 | 1.04 | 0.02 | <0.01 | 36 | 56.7 | 128.7 | 27.7 |

Figure 6:
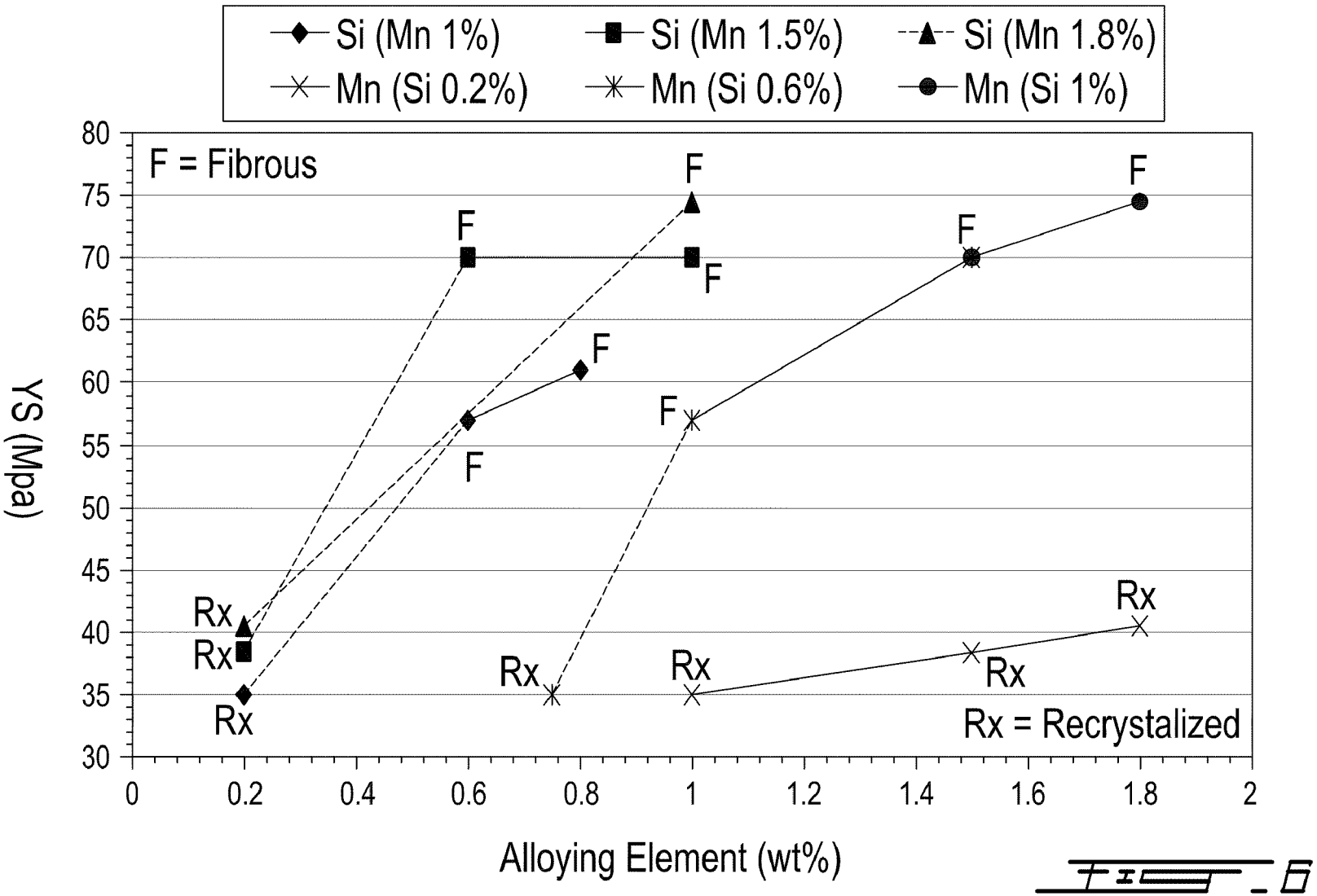
FIG. 6 is a graph showing the as-extruded yield strength values for alloys 1 to 11 presented in Table 4.
Figure 7:
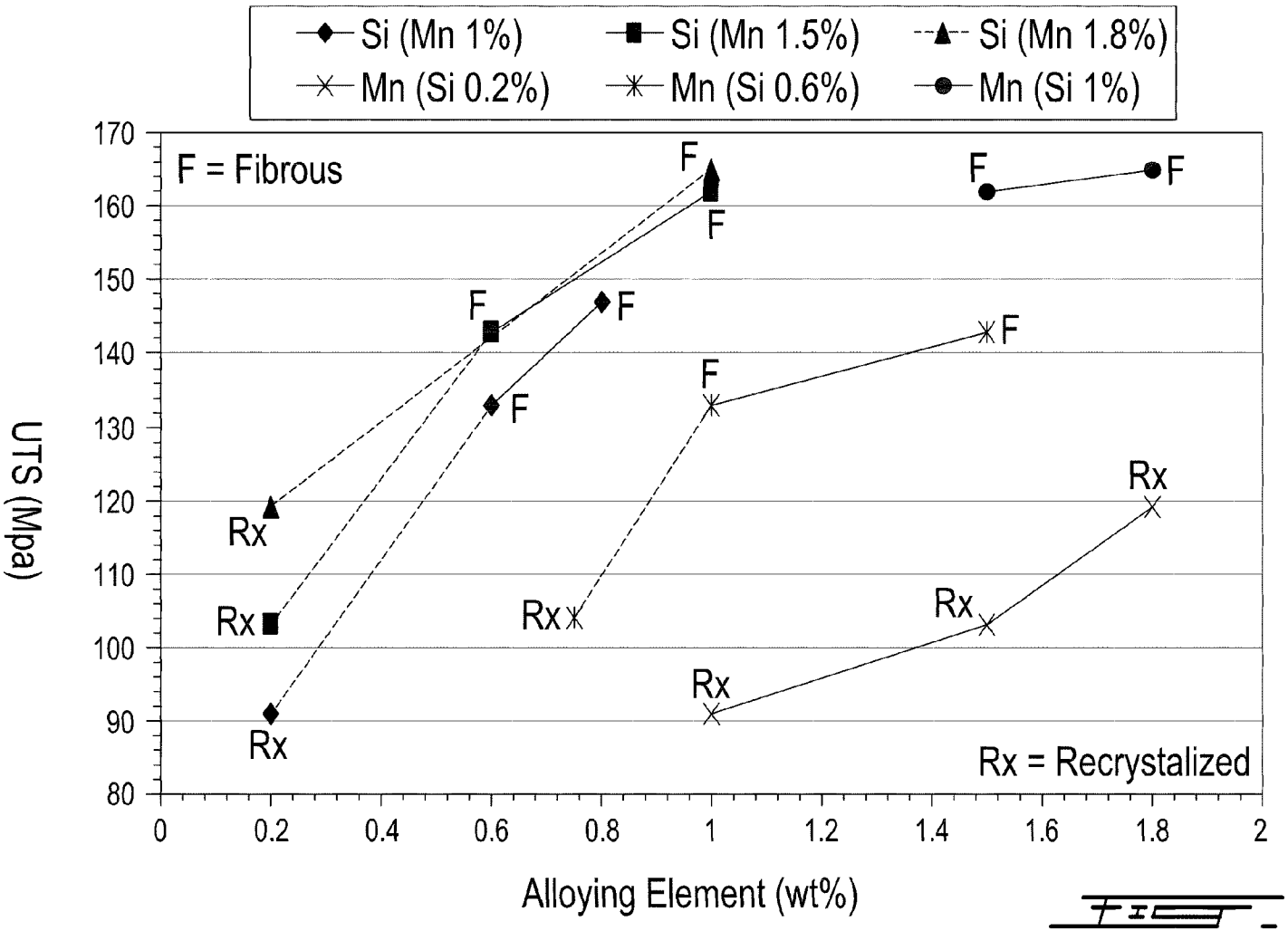
FIG. 7 is a graph showing the as-extruded tensile strength values for alloys 1 to 11 presented in Table 4.
Figure 8:
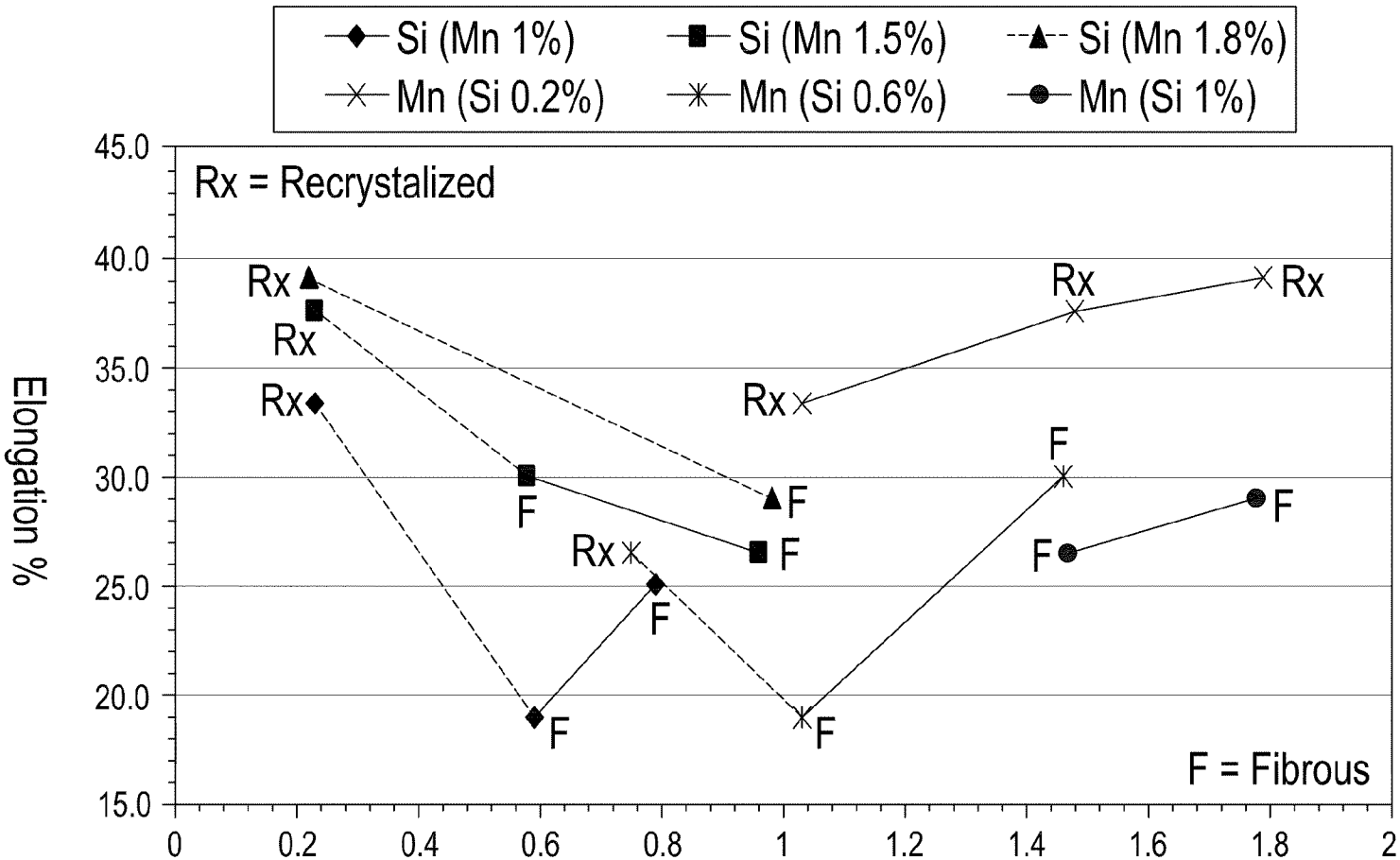
FIG. 8 is a graph showing the as-extruded elongation values for alloys 1 to 11 presented in Table 4.

The impact of manganese and silicon on the mechanical properties is shown in FIGS. 6 to 8. FIGS. 6 and 7, illustrating respectively the yield and the tensile strengths, visually show that higher levels of silicon and manganese alone are not sufficient enough to produce the fibrous structure associated with improved strength. Improved strength is obtained with an appropriate combination of silicon and manganese contents.

In accordance with one exemplary embodiment, the target performance characteristics of the aluminium extrusions are as follows: the resulting alloy should have a yield strength above 50 MPa, which represents approximately a 40% increase over AA 3003, a tensile strength higher than 125 MPa, which also represents approximately a 40% increase over AA 3003, an elongation above 15%, and a recrystallization below 40%. Based on the results presented in Table 4, these targets are met when the silicon content is higher or equal to 0.58 wt % (approximately 0.6 wt %) and the manganese content is higher or equal to 1.03 wt % (approximately 1.0 wt %). As mentioned above, increasing solely the manganese content or solely the silicon content is not sufficient enough. For example, alloy 2, having 1.48 wt % Mn and 0.23 wt % Si, and alloy 3, having 1.79 wt % Mn and 0.23 wt % Si, did not meet any of the above described targets. Similarly, alloy 10, having 0.75 wt % Mn and 0.58 wt % Si, did not meet the target values. Alloy 11, having 1.04 wt % Mn and 0.59 wt % Si, met these targets. This indicates that a copper content lower than 0.01 wt % and an iron content of approximately 0.10 wt % are sufficient when the silicon and manganese criteria are satisfied.

Experiment C

The tendency for any alloy to recrystallize during extrusion increases with the speed of extrusion due to the increased stored work introduced. An alloy capable of retaining a fibrous grain structure at a higher exit speed is advantageous since it offers the combination of good mechanical properties and good press productivity. Experiment C was conducted to compare the interrelation between grain structure and exit speed for selected alloy compositions.

Billets of alloys 4, 6, 7, and 8 were homogenized using the same conditions as experiment B. The billets were extruded using the same die as experiment B using an initial billet temperature of 480° C. and a range of exit speeds. The grain structure of the resulting strip was examined and the recrystallized fraction measured. The results are shown in Table 5, reproduced below.

TABLE 5

Grain structure results showing % of thickness recrystallized - Experiment C.

| | Exit Speed (m/min) | | | | |
|---|---|---|---|---|---|
| Alloy | 20 | 40 | 60 | 80 | 100 |
| 4 | | | <3 | <3 | <3 |
| 6 | | | <3 | <3 | <3 |
| 7 | 100 | 100 | 100 | | |
| 8 | | 11 | 50 | | |

Standard AA 3003, alloy 7, was fully recrystallized over the range of test conditions used, even at a low exit speed of 20 m/min. The exit speed at which the fibrous/recrystallized transition occurred was not established but it was clearly below 20 m/min. Alloys 4 and 6, having a manganese content above 1.45 wt % and a silicon content above 0.58 wt %, retained a substantially fibrous grain structure over the speed range tested, up to 100 m/min, indicating that the transition speed was above 100 m/min. Alloy 8, having a manganese content of 1.03 wt % and a silicon content of 0.59 wt %, which is close to the lower limits of the aluminium alloy of the invention, met the recrystallization target, i.e. less than 40%, at an exit speed of 40 m/min.

Mechanical properties were not evaluated but they are expected to follow the retention of the fibrous grain structure in the microstructure.

Therefore, the aluminium extrusions manufactured from the above-described aluminium alloys can offer significant productivity gains compared to standard AA 3003 alloy. In one embodiment, the productivity gains are of at least 100%. Furthermore, with a composition range having at least 0.58 wt % silicon and at least 1.45 wt % manganese, the productivity gains can reach 500% while still maintaining a fibrous structure.

Referring to experiment B, aluminium alloys 4, 5, 6, 8, 9, and 11 offer advantages over standard AA 3003 (alloys 1 and 7). Aluminium alloys 2, 3, and 10 do not offer useful advantages over standard AA 3003 (alloys 1 and 7). The effects of the various individual alloying elements can be summarized as follows.

As shown in the experiments, silicon levels higher or equal to than 0.58 wt %, when combined with manganese levels higher or equal to 1.03 wt %, promote a fibrous structure in the aluminium extrusion associated with a useful strength increase compared to AA 3003. Adding too much silicon can depress the alloy melting point, which can be detrimental to extrudability by causing early onset of surface defects. Increasing silicon contents up to 0.99 wt % gave some further benefits in strength and reduced surface recrystallization, but the ratio YSreI/PreI, which represents the strength/extrudability factor, lowered. For this reason, in one embodiment, the silicon content should be kept below 1.1 wt %.

When added alone to an aluminium alloy in a concentration ranging between approximately 1.0 and 1.8 wt %, manganese is not a potent strengthening agent. However, the addition of manganese causes a significant increase in extrusion pressure. Also, at the upper end of this range, there is a possibility of forming primary $MnAl_6$ particles during casting. These particles are detrimental to subsequent processing and the resulting mechanical properties. Consequently, the strength/extrudability ratio (YSreI/PreI) for alloys with increased manganese levels, without a corresponding increase of the silicon content, is low. The best combination of strength and extrudability was obtained for 1.45 wt % of manganese with a 0.58 wt % of silicon.

In the experiments described above, the compositions tested were by necessity changed incrementally. Thus, it is anticipated that compositions slightly more dilute, in manganese and silicon, than the examples shown could still offer advantages over standard AA 3003.

It will be noted that aluminium alloy 11 having less than 0.01 wt % Cu showed improved strength over standard AA 3003

In the above-described experiments, the titanium contents were associated with grain refiner additions and were typically below 0.03 wt %.

While aluminium extrusions made with the aluminium alloys described above in accordance with the invention may be used for making tubes and other profiles used in heat exchangers, they will be useful for other structural applications such as profiles ranging from sunroof tracks to some automotive crash structures. It is appreciated that the aluminium extrusions according to the invention can be used for any extruded application where a combination of strength, ductility and extrudability is required, as well as any other application where such properties are desired.

Several alternative embodiments and examples have been described and illustrated herein. The embodiments of the invention described above are intended to be exemplary only. A person of ordinary skill in the art would appreciate the features of the individual embodiments, and the possible combinations and variations of the components. A person of ordinary skill in the art would further appreciate that any of the embodiments could be provided in any combination with the other embodiments disclosed herein. It is understood that the invention may be embodied in other specific forms without departing from the spirit or central characteristics thereof. The present examples and embodiments, therefore, are to be considered in all respects as illustrative and not restrictive, and the invention is not to be limited to the details given herein. Accordingly, while the specific embodiments have been illustrated and described, numerous modifications come to mind without significantly departing from the spirit of the invention. The scope of the invention is therefore intended to be limited solely by the scope of the appended claims.

The invention claimed is:

1. An aluminium extrusion having a minimum section thickness and made from an aluminium alloy having, in weight percent, between approximately 1.0 and 1.7 manganese, between approximately 0.5 and 1.1 silicon, less than 0.3 iron, and below approximately 0.01 copper, with the balance being Al and inevitable impurities each less than 0.05 weight % and totaling less than 0.15 weight %, the extrusion being formed with an extrusion ratio less than 125 to retain a fibrous grain structure in which less than 40% of the minimum section thickness is recrystallized, and wherein the fibrous grain structure is centrally located within a wall of the extruded component.

2. An aluminium extrusion as claimed in claim 1 intended for use in corrosion resistant applications, the alloy having at least one additional alloying element selected from a group consisting of: zinc greater than 0.10 and less than 0.30 weight % and titanium greater than 0.10 and less than 0.20 weight %.

3. An aluminium extrusion as claimed in claim 1, wherein less than 25% of the minimum section thickness is recrystallized.

4. An aluminium extrusion as claimed in claim 1, wherein the minimum section thickness is larger or equal to 1.0 mm.

5. An aluminium extrusion as claimed in claim 1, wherein the component has a yield strength higher than 50 MPa, a tensile strength higher than 125 MPa, and an elongation above 15%.

6. An aluminium extrusion as claimed in claim 1, wherein the extrusion ratio is less than 75.

7. An aluminium extrusion as claimed in claim 1, wherein the manganese content ranges between approximately 1.4 and 1.6 wt %.

8. An aluminium extrusion as claimed in claim 1, wherein the silicon content ranges between approximately 0.5 and 0.7 wt %.

9. An aluminium extrusion as claimed in claim 1, wherein the aluminium alloy is subjected to a single step homogenization.

10. An aluminium extrusion as claimed in claim 1, wherein the minimum section thickness is larger or equal to 2 mm.

11. An aluminium extrusion as claimed in claim 1, wherein the wall has surface layers surrounding the fibrous grain structure, with the surface layers having recrystallized grain structures.

12. An aluminium extrusion as claimed in claim 11, wherein the wall has a thickness defining the minimum section thickness.

13. An aluminium extrusion having a wall having a thickness defining a minimum section thickness and made from an aluminium alloy having, in weight percent, between approximately 1.0 and 1.7 manganese, between approximately 0.5 and 1.1 silicon, less than 0.3 iron, and below approximately 0.01 copper, with the balance being Al and inevitable impurities each less than 0.05 weight % and totaling less than 0.15 weight %, the extrusion being formed with an extrusion ratio less than 125 to achieve a grain structure in which less than 40% of the minimum section thickness is recrystallized, and wherein the wall has a central portion within the thickness having an unrecrystallized grain structure and surface layers surrounding the central portion and having recrystallized grain structures.

14. An aluminium extrusion as claimed in claim 13, wherein less than 25% of the minimum section thickness is recrystallized.

15. An aluminium extrusion as claimed in claim 13, wherein the minimum section thickness is larger or equal to 1.0 mm.

16. An aluminium extrusion as claimed in claim 13, wherein the component has a yield strength higher than 50 MPa, a tensile strength higher than 125 MPa, and an elongation above 15%.

17. An aluminium extrusion as claimed in claim 13, wherein the manganese content ranges between approximately 1.4 and 1.6 wt %.

18. An aluminium extrusion as claimed in claim 13, wherein the silicon content ranges between approximately 0.5 and 0.7 wt %.

19. An aluminium extrusion as claimed in claim 13, wherein the minimum section thickness is larger or equal to 2 mm.

* * * * *